US006802388B2

(12) United States Patent
Wolf et al.

(10) Patent No.: US 6,802,388 B2
(45) Date of Patent: Oct. 12, 2004

(54) SILENCER OR NOISE DAMPER

(75) Inventors: Franz Josef Wolf, Bad Soden-Salmünster (DE); Udo Gärtner, Sinntal-Sannerz (DE); Josef Hohmann, Steinau-Ürzell (DE); Anton Wolf, Gelnhausen (DE)

(73) Assignee: WOCO Franz-Josef Wolf & Co. GmbH, Bad Soden-Salmuenster (DE)

( * ) Notice: Subject to any disclaimer, the term of this patent is extended or adjusted under 35 U.S.C. 154(b) by 73 days.

(21) Appl. No.: 10/344,596

(22) PCT Filed: Jun. 13, 2001

(86) PCT No.: PCT/EP01/06893

§ 371 (c)(1),
(2), (4) Date: Feb. 13, 2003

(87) PCT Pub. No.: WO02/101227

PCT Pub. Date: Dec. 19, 2002

(65) Prior Publication Data

US 2003/0173146 A1 Sep. 18, 2003

(51) Int. Cl.[7] ..... F10N 1/08
(52) U.S. Cl. ..... 181/265
(58) Field of Search ..... 181/265, 264, 181/266, 210, 211, 229, 238, 241, 255

(56) References Cited

U.S. PATENT DOCUMENTS 4,890,691 A * 1/1990 Ching-ho ..... 181/264
5,650,599 A * 7/1997 Madden et al. ..... 181/218
5,739,484 A * 4/1998 Jones ..... 181/264
5,979,598 A 11/1999 Wolf et al.

FOREIGN PATENT DOCUMENTS

| | | |
|---|---|---|
| DE | 195 00 450 | 7/1995 |
| DE | 197 03 414 | 8/1998 |
| EP | 0 834 011 | 5/2000 |
| FR | 63.026 | 7/1955 |
| WO | WO 80/02304 | 10/1980 |
| WO | WO 97/09527 | 3/1997 |

* cited by examiner

*Primary Examiner*—Kimberly Lockett
(74) *Attorney, Agent, or Firm*—Schiff Hardin LLP

(57) ABSTRACT

The invention relates to a silencer (1) for noise-laden gas pipes, especially for a suction pipe and/or an exhaust pipe of an internal combustion engine, comprising an outer pipe (2) with an inlet side (3) and an outlet side (4), a plurality of diaphragm rings (9, 9', 9", '", 9"") each with an outer surface connected (5) to the inner surface of the outer pipe (2), at least one insert (6) with an outer surface connected (7) to the inner surface of the outer pipe (2) and/or the diaphragm rings (9, 9', 9", 9'", 9"") and with a plurality of openings (8) which are closed on one side. Said insert (6) forms sub-pipes for the gas flow in the silencer, and the openings (8), which are closed on one side, open into the sub-pipes, the depth thereof being /4 in relation to the wavelength of a frequency to be silenced. At least one perforated wall (10, 10', 11, 11'), extends between at least two diaphragm rings (9, 9', 9", 9'", 9"") whereby an outer surface is connected (7) to at least one inner surface of the two diaphragm rings (9, 9', 9'", 9"", wherein at least one resonance cell is fixed between the two diaphragm rings (9, 9', 9", 9'", 9"") of the perforated wall (10, 10', 11, 11') and the outer pipe (2).

19 Claims, 2 Drawing Sheets

SILENCER OR NOISE DAMPER

BACKGROUND OF THE INVENTION

The invention is directed to a noise damper or silencer for pipelines carrying noise-laden gasses, particularly for an intake line and/or exhaust gas line of an internal combustion motor. The damper comprises an outside pipe with an admission side and a discharge side, a plurality of diaphragm rings having a respective outside surface in communication with the inside surface of the outside pipe and at least one insert having an outside surface in communication with either the inside surface of the outside pipe and/or of the diaphragm rings. The insert has a plurality of openings closed at one side, and the insert forms sub-lines or passages for the gas flow in the noise damper. The openings closed at one side open into the sub-lines and have a depth of $\lambda/4$ with reference to the wavelength $\lambda$ of a frequency to be damped.

A fundamental distinction is made between three types of damper that are based on different physical principles, namely:

1. Absorption noise dampers

What is expected of an absorption noise damper is that higher, especially bothersome frequencies are absorbed, sucked up by absorption materials or, respectively, converted into frictional heat.

EP 0 834 011 B1, for example, discloses an absorption noise damper for an internal combustion motor composed of an intake pipe carrying the intake air and of a resonator housing that surrounds the former upon formation of a closed resonance space. In addition, the absorption sound damper is equipped with an admission muff and a discharge muff, and has openings in the pipe wall of the intake pipe that connect the interior of the intake pipe to the interior of the resonator. A chamber wall of an axial sequence of a plurality of chamber walls directed transverse relative to the longitudinal axis of the intake pipe thereby forms or, respectively, form resonator chambers of different volume in the resonator housing that are hermetically limited from one another, so that each resonator chamber communicates with the interior of the intake pipe via openings in the pipe wall of the intake pipe without bridging chamber walls, and comprises a mutually matched dimensioning of the resonator chamber volume, of the cross-sectional area of the opening and of the thickness of the intake pipe in the region of the respective opening corresponding to the wall height of the openings for each individual resonator chamber at the position and width if a resonator frequency band that is respectively structurally prescribed therefor. Each opening and the appertaining resonator chamber therefore respectively form a Helmholtz resonator tuned to the frequency band to be absored, i.e. to be damped.

2. Reflection sound dampers

The function of reflection sound dampers is based both on reflection of sound waves as well as on reflection of sound waves to the acoustic source and on multiplication of sound points. The damping is thereby all the more effective when the reflection locations are more numerous.

For example, WO 97/09 527 discloses a reflection sound damper for gas-carrying pipelines having an admission, a discharge and a chamber lying between these connections in the air intake tract of an internal combustion motor, links or diaphragms that re duce the flow cross-section of the chamber being arranged in said chamber transverse to the flow direction.

3. Interference sound dampers

In interference sound dampers, a part of the acoustic energy is extinguished when merged after covering paths of different length.

Many combinations of the sound damper types recited above are, of course, known in the Prior Art. For example, DE 197 03 414 A1, which defines the species, discloses a specific combination of sound damping mechanisms. This discloses a combination of a reflection sound damper in the form of diaphragm rings connected axially following one another and a resonance damper in the form of $\lambda/4$ resonators. The high flow losses due to the diaphragm rings are disadvantageous in the known noise damper; moreover, there is still not a satisfactory tunability of the frequencies to be damped, neither in view of the range nor the broadband quality.

SUMMARY OF THE INVENTION

The invention is therefore based on the object of developing the noise damper of the species to the effect that the disadvantages of the Prior Art are overcome, and a tunable damping is possible particularly in the frequency range from 1 through 20 kHz.

The present object of the invention is achieved by at least one apertured wall that extends between at least two diaphragm rings with an outside surface in communication with at least the inside surface of the two diaphragm rings, so that at least one resonance chamber is defined between the two diaphragm rings, the apertured wall and the outside pipe.

It can be provided that the insert comprises essentially plate-shaped inside walls that are provided on both sides with blind holes or openings closed at one side. The inserts are arranged essentially cross-shaped or star-shaped in a radial cross-section and preferably extend over essentially the entire axial length of the outside pipe.

It is also proposed that the blind holes or openings closed at one side are arranged offset relative to one another on both sides of an inside wall.

It is also provided that the openings closed on one side are arranged essentially in rows from the admission side to the discharge side, whereby the depth of the openings closed on one side is the same within a row and different from row to row, preferably with increasing depth from the admission side to the discharge side.

It is also inventively proposed that the distance between the diaphragm rings differs, preferably increasing from the admission side to the discharge side.

A preferred embodiment of the invention is characterized in that at least one resonance chamber and at least one hole in the apertured wall of the resonance chamber form a Helmholtz resonator that can be tuned to a frequency band to be damped via the volume of the resonance chamber, the cross-sectional area of the hole in the apertured wall of the resonance chamber and the wall thickness of the apertured wall of the resonance chamber in the region of the hole.

It can thereby be provided that the wall thickness of the apertured wall amounts to 0.6 through 5 mm, and is preferably 1 through 3 mm.

It is also proposed that one or more apertured walls arranged following one another from the admission side to the discharge side extends or, respectively, extend over the entire axial length of the outside pipe, and preferably concentrically within the outside pipe.

It is also preferred that a plurality of resonance chambers are provided, whereby frequency bands to be damped by neighboring resonance chambers preferably at least partially overlap and/or the resonance chambers form reflection sound dampers and/or absorption sound dampers.

It can also be provided that the diaphragm rings are provided with blind holes or openings closed at one side that open into the sub-lines or passages

BRIEF DESCRIPTION OF THE DRAWINGS

Thereby shown are.

DESCRIPTION OF A PREFERRED EMBODIMNT

Figure 1:
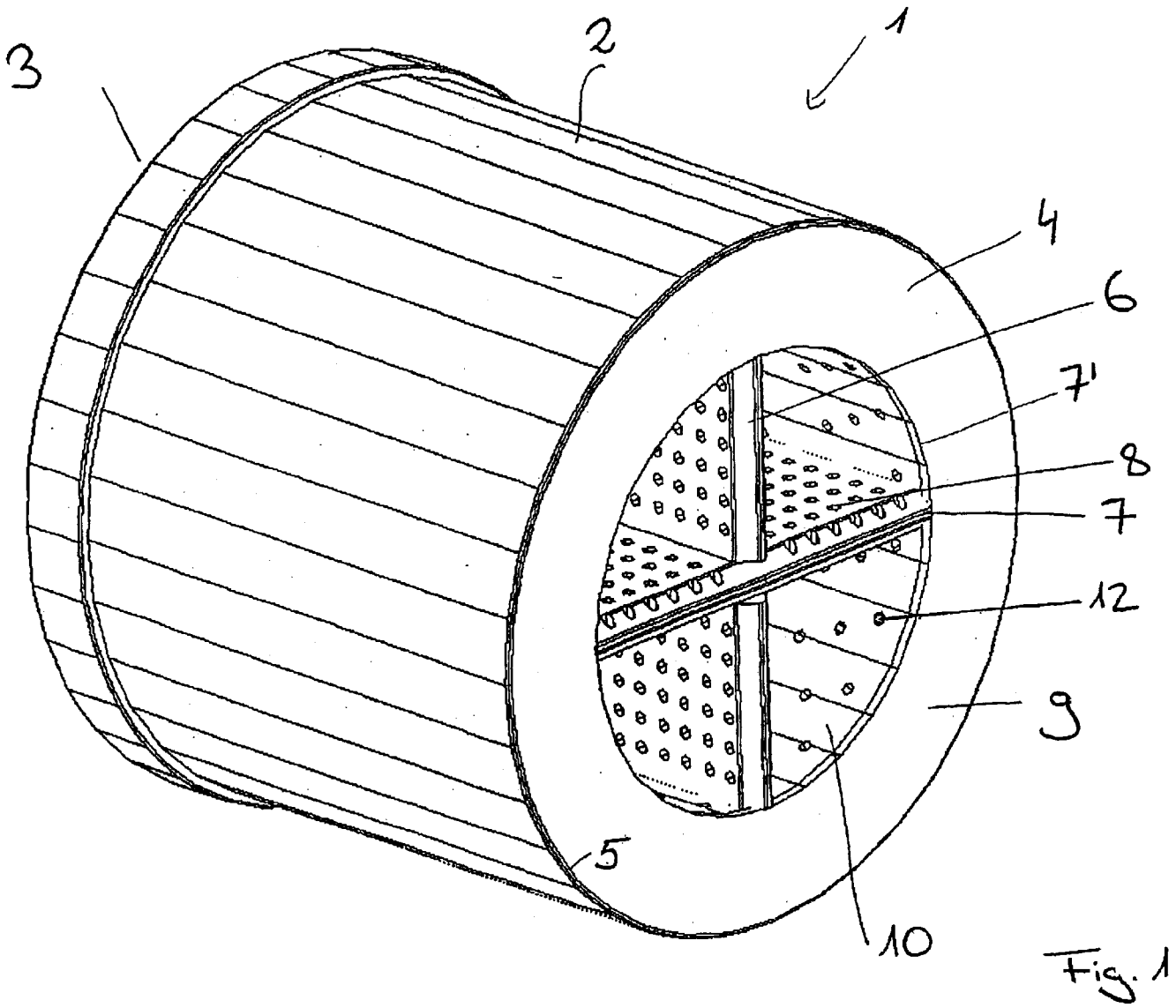
FIG. 1 is a perspective view of an inventive noise damper.
Figure 2:
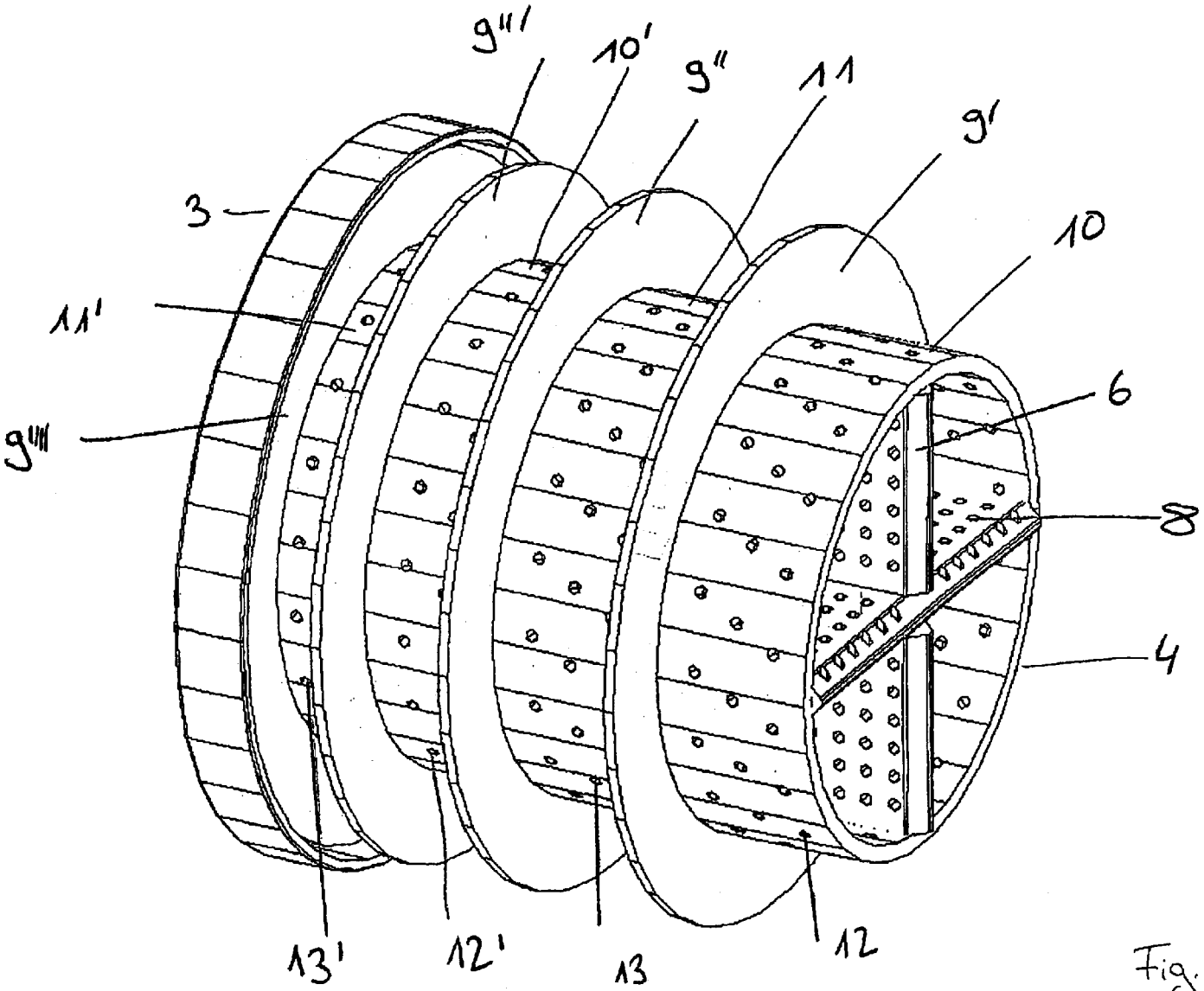
FIG. 2 is a perspective view according to FIG. 1 with partially removed outside pipe.

As can be derived from FIGS. 1 and 2, an inventive noise damper or silencer 1 comprises an outside pipe 2 with an admission side 3, a discharge side 4 and a contact surface 5, an insert 6 having a contact surface 7 and openings closed at one side or, respectively, blind holes 8, a plurality of diaphragm rings 9, 9', 9", 9'", 9"", and apertured diaphragms 10, 10', 11, 11' with holes 12, 12', 13, 13'. The diaphragm rings 9, 9', 9", 9'", 9"" are arranged between the outside pipe 2 and the insert 6 so that the contact surface 5 proceeds between the outside pipe 2 and the diaphragm rings 9, 9', 9", 9'", 9"" and the contact surface 7 proceeds between the diaphragm rings 9, 9', 9", 9'", 9"" and the insert 6, whereby the insert 6 proceeds essentially concentrically within the outside pipe 2.

Four sub-lines or passages, which are separated from one another, are offered in the noise damper 1 as a result of the insert 6. The blind holes 8 respectively open toward the sub-lines, are partly arranged at opposite surfaces, preferably offset, and comprise a depth that is tuned to one-fourth of the wavelength of the frequency to be damped out from the overall spectrum. An excellent broadband quality of the damping can be achieved by means of a targeted variation of the depth of the blind holes 8 over the totality of the insert 6, whereby the depth increases from the admission side 3 to the discharge side 4.

The apertured walls 10, 10', 11, 11', the diaphragm rings 9, 9', 9", 9'", 9"" and the outside pipe 2 limit four resonance chambers. The resonance: chambers represent either additional reflection sound dampers or resonance sound and also have a depth of $\lambda/4$, whereby the depth preferably increases from the admission side to the discharge side.

It is also proposed that the outside pipe, the diaphragm rings, the insert and/or the apertured wall or, respectively, the apertured walls is or, respectively, are fashioned of a metal, particularly aluminum, a heat-resistant plastic, particularly a fiber-reinforced plastic, hard rubber and/or a ceramic, such as a porous sintered material.

It can also be provided that the outside pipe, the diaphragm rings, the apertured wall and/or the insert are integrally formed, preferably as an aluminum diecasting.

Finally, it is proposed that the outside pipe, the insert, the openings closed at one side in the insert and/or the holes in the apertured wall is or, respectively, are essentially rotationally symmetrical, preferably circular, in radial section.

The invention is thus based on the surprising perception that a multiple combination of reflection sound dampers and resonance sound dampers enables a tuning of a frequency range from 1 through 20 kHz to be damped without significant flow losses given a compact structure. The corresponding combination is thereby based on the utilization of one or more apertured walls, so that the diaphragm rings functions both as reflection walls as well as for the limitation of Helmholtz resonators upon formation of absorption sound dampers in addition to the $\lambda/4$ resonators of the insert without leading to substantial flow losses.

Further features and advantages of the invention can be derived from the following description wherein an exemplary embodiment of the invention is explained in detail by way of example on the basis of schematic drawings. dampers depending on the design of the apertured wall 10, 10', 11, 11'. A reflection sound damper is thus present when the apertured wall 10, 10' is formed, for example, of a thin steel sheet, whereas a resonance sound damper is present when the apertured wall 11, 11' comprises a wall thickness is a range from 0.6 through 5 mm, so that each hole 13, 13' together with the resonance chamber forms a Helmholtz resonator tunable to the frequency band to be damped via absorption. The apertured walls 10, 10', 11, 11' not only offer an additional possibility of tuning a frequency band to be damped but also simultaneously assure a reduction of the flow losses due to the formation of eddies at the diaphragm rings 9, 9', 9", 9'", 9"". As a result thereof, the noise damper 1 is considerably improved overall compared to the Prior Art.

Neither the outside pipe 2 nor the apertured walls 10, 10', 11, 11' need be designed circular in a radial cross-section. The resonance behavior of every individual sound-absorbing resonance chamber is ultimately defined only by the oscillating air volume in view of its resonant frequency, so that the inventive noise damper 1 can be adapted to practically any available installation space given the smallest possible structure.

Both individually as well as in any arbitrary combination, the features of the invention disclosed in the above specification, in the claims as well as in the drawings can be critical for the realization of the various embodiments of the invention.

We claim:

1. A noise damper for pipelines carrying noise-laden gasses, said noise damper comprising an outside pipe having an inside surface, an admission side, and a discharge side; a plurality of diaphragm rings having respective outside surfaces in communication with the inside surface of the outside pipe; at least one aperture wall extending between at least two diaphragm rings with an outside surface in communication with at least the inside surfaces of the two diaphragm rings to form at least one resonance chamber between the two diaphragm rings, the aperture wall and the outside pipe; and at least one insert having an outside surface in communication with one of the inside surface of the outside pipe, the diaphragm rings and said at least one aperture wall, said at least one insert having a plurality of blind holes, the insert forming sub-lines for gas flow in the noise damper, and the blind holes opening into the sub-lines and having a depth of $\lambda/4$ with reference to a wavelength $\lambda$ of a frequency to be damped.

2. A noise damper according to claim 1, wherein the at least one insert comprises essentially plate-shaped inside walls that are arranged essentially in one of a cross-shape, a star-shape and a radial cross-section, and preferably extend over essentially the entire axial length of the outside pipe, said essentially plate-shaped inside walls being provided on both sides with the blind holes.

3. A noise damper according to claim 2, wherein the blind holes are arranged offset relative to one another on both sides of an inside wall.

4. A noise damper according to claim 1, wherein the blind holes on one side are arranged essentially in rows from the admission side to the discharge side with the depth of the blind holes being the same within a row and different from row to row.

5. A noise damper according to claim 4, wherein the depth of the blind holes increases from the admission side to the discharge side.

6. A noise damper according to claim 1, wherein the distance between diaphragm rings differs.

7. A noise damper according to claim 6, wherein the distance between diaphragm rings increases from the admission side to the discharge side.

8. A noise damper according to claim 1, wherein the at least one resonator chamber and the at least one hole in the aperture wall of the resonator chamber form a Helmholtz resonator, which is tuned to a frequency to be damped via the volume of the resonator chamber, the cross-sectional area of the hole in the aperture wall of the resonator chamber and the wall thickness of the aperture wall of the resonator chamber in the region of the hole.

9. A noise damper according to claim 8, wherein the wall thickness of the aperture wall is in a range of 0.6 through 5 mm.

10. A noise damper according to claim 9, wherein the wall thickness of the aperture wall is in a range of 1 through 3 mm.

11. A noise damper according to claim 9, wherein a plurality of resonator chambers are provided, the frequency band to be damped by neighboring resonator chambers preferably at least partially overlaps and at least one of the plurality of resonator chambers forms a damper selected from a reflection sound damper and an absorption sound damper.

12. A noise damper according to claim 1, which includes more than one aperture wall arranged following one another from the admission side toward the discharge side extending along the axial length of the outside pipe.

13. A noise damper according to claim 12, wherein a plurality of resonator chambers are provided, whereby frequency bands to be damped neighboring resonator chambers are partially overlapped and at least one resonator chamber is selected from a damper including reflection sound dampers and absorption sound dampers.

14. A noise damper according to claim 1, wherein the diaphragm rings are provided with blind holes opening into sub-lines, said blind holes having a depth of $\lambda/4$ of the wavelength $\lambda$ to be damped and the depth increases from the admission side to the discharge side of the damper.

15. A noise damper according to claim 1, wherein the outside pipe, the diaphragm rings, the insert and the aperture wall are of a material selected from a group consisting of a metal, a heat-resistant plastic, a hard rubber and a ceramic.

16. A noise damper according to claim 15, wherein the metal is aluminum, the heat-resistant plastic is a fiber-reinforced plastic and the ceramic is a porous sintered material.

17. A noise damper according to claim 1, wherein the outside pipe, the diaphragm rings, the aperture wall and the insert are an integrally formed member.

18. A noise damper according to claim 17, wherein the integrally formed member is an aluminum diecasting.

19. A noise damper according to claim 1, wherein the outside pipe, the insert, the blind holes and the holes in the aperture walls are essentially rotationally symmetrical in the radial section.

* * * * *